United States Patent [19]

Polo

[11] 4,072,100

[45] Feb. 7, 1978

[54] NUMBERING MACHINE ASSEMBLY ESPECIALLY ADAPTED FOR USE WITH PRINTING MACHINERY

[76] Inventor: Francois Polo, 7, rue Jean Jaures, 93140 Bondy, France

[21] Appl. No.: 710,868

[22] Filed: Aug. 2, 1976

[30] Foreign Application Priority Data

| | | |
|---|---|---|
| Aug. 7, 1975 | France | 75 24617 |
| July 6, 1976 | France | 76 20642 |

[51] Int. Cl.[2] ..... B41L 45/00

[52] U.S. Cl. ..... 101/79; 101/72; 340/146.1 BE; 235/307

[58] Field of Search ..... 101/72, 79, 76, 84, 101/90, 110; 235/61.7 R, 61.7 A, 153 AS, 153 AE; 340/146.1 BE, 146.1 BA

[56] References Cited

U.S. PATENT DOCUMENTS

| | | | |
|---|---|---|---|
| 3,141,403 | 7/1964 | Brown et al. | 101/110 X |
| 3,624,372 | 11/1971 | Philip et al. | 340/146.1 BE X |
| 3,931,505 | 1/1976 | Sevcik | 235/153 AE |
| 3,965,815 | 6/1976 | Lupkas et al. | 101/110 X |
| 3,978,327 | 8/1976 | Huber | 340/146.1 BE X |
| 3,998,312 | 12/1976 | Fujimi et al. | 101/110 X |

*Primary Examiner*—Edward M. Coven
*Attorney, Agent, or Firm*—Brisebois & Kruger

[57] ABSTRACT

At least two numbering machines are connected to be operated simultaneously. Each printing disc in each machine is connected to control an electrical signal in dependence on which of each two consecutive printing faces on said disc is in a position to print. An indicator is provided which compares the signals of the two machines and gives warning if they do not correspond.

16 Claims, 8 Drawing Figures

NUMBERING MACHINE ASSEMBLY ESPECIALLY ADAPTED FOR USE WITH PRINTING MACHINERY

In order to carry out certain printing operations it is necessary to introduce into the printing machinery a numbering machine which, after each printing cycle, is subjected to an impulse which varies the number printed by the numbering machine, usually by one digit. These numbering machines consist of a series of serrated discs positioned parallel to each other on a common axis, each of said discs being associated with a ratchet wheel which is controlled by the pawls of a reciprocating pawl carrier. The movement of the pawl carrier is itself controlled by a pushbutton on which the impulse which actuates the numbering machine is exerted. The serrated discs of the numbering machine are thus controlled through a mechanical chain of transmission which is fairly complex and may, for this reason, be disturbed in various ways. It is possible, for example, that the pawl associated with a disc does not move in response to one of the impulses because of the presence of a solid particle, in which case the disc remains in the position which it previously occupied instead of turning by one notch. It is also possible, despite the precautions which are taken against it, that, in response to the impulse imparted by the pawl associated therewith, a disc will turn through an angle greater than the one corresponding to the passage from one number to the next. It is also possible that a disc will turn for less than the width of a notch and remain locked between two successive printing positions. In these three cases an error in numbering is produced. If the printing machine has only a single numbering device, the error in the operation of a disc only leads to a limited printing error. On the contrary, if the printing machine has several numbering machines which must indicate an identical number, the error in the operation of one of the numbering machines results in an error in all the sheets printed after the original error occurred since for these subsequent impressions, the numbers of the different numbering machines are no longer identical. In such a case it is therefore necessary to check the production of a printing machine, which is particularly difficult in the case of machines operating at high speeds.

It is the object of the present invention to mitigate this disadvantage by providing a numbering assembly which makes it possible to automatically detect errors in the operation of a numbering machine. In accordance with the invention reliance is placed upon the fact that an error in the operation of one of the discs of the numbering machine occurs by chance and never occurs at the same moment as another operating error in a similar numbering machine controlled in a synchronous manner. In accordance with the invention information relative to the determination of the position of two corresponding serrated discs of two numbering machines is compared and, if the information is identical, one is assured that there has been no error in operation by the discs of the numbering machine being checked, and is thus led to associate a monitoring numbering machine with each numbering machine the operation of which is to be checked, and to create an error signal when the position of a serrated disc of the numbering machine being checked differs in position from the corresponding serrated disc of the monitoring numbering machine. On contrary, when the printing machine comprises several numbering machines which operate simultaneously, the monitoring numbering machine associated with a numbering machine being checked may advantageously be one of the other numbering machines used in the printing machine in which case the total number of numbering machines used is not increased. On the contrary, when the printing machine comprises only a single numbering machine, it is necessary to add to this numbering machine a monitoring numbering machine which is not used in printing.

It is therefore an object of the present invention to provide a new article of manufacture which consists of an assembly of numbering machines adapted to be inserted, for example in a printing machine, said assembly comprising a numbering machine the operation of which is checked and which consists of a plurality of serrated discs capable of being driven in rotation to pass from one stop position to the next, characterized by the fact that it comprises at least one monitoring numbering machine which normally operates in synchronism with the numbering machine being checked, each serrated disc of the monitoring numbering machine having the same number of stop positions as the corresponding serrated disc of the numbering machine being checked, and controlling for each stop position an indicator which produces a signal, the signals from two corresponding serrated wheels being combined to produce an information signal, all the information signals pertinent to all the serrated discs being combined to produce an error signal if at least one of the serrated discs of the numbering machine being checked is in a position different from that of the corresponding serrated disc of the monitoring machine or machines.

In a first method of carrying out this invention the serrated discs of the numbering machine being checked and those of the monitoring machine generate for each stop position an indicating signal which differs from one stop position to the next, the signals corresponding to one serrated disc of the numbering machine being checked and to the corresponding serrated disc of the monitoring numbering machine being fed to a comparator which, in the absence of concordance, produces an error signal.

In a second embodiment, each serrated disc of the numbering machine being checked or the monitoring numbering machine is associated with two electrically supplied switches, each having an output, the first of said switches being in an open position when the face of the serrated disc in printing position corresponds to an even number and in a closed position when the face of the serrated disc in a printing position corresponds to an odd number, while the second switch operates in the opposite way, the output of the first and second switches of each serrated disc of the numbering machine being checked being connected in series respectively to the inputs of the first and second switches of the corresponding serrated disc of the monitoring numbering machine or machines, an error signal being emitted when at least one of the outputs of the series of the first or second switch receives an input different from the outputs of the other series of first or second switches respectively.

In a third embodiment, each disc of a numbering machine being checked or a monitoring numbering machine is associated with a switch having two outputs, the first putput is not supplied when the face of the serrated disc in printing position corresponds to an even number and is supplied when the face of the serrated disc in printing position corresponds to an odd number, whereas the supply to the second output occurs in the opposite manner, the first and second outputs of the switch of each serrated disc in the numbering machine being checked being connected in parallel respectively to the first and second outputs of the switches of the corresponding serrated disc of the monitoring numbering machine, an error signal being emitted when the two output lines corresponding to the switches of corresponding serrated discs in the numbering machine being checked and the monitoring numbering machine are simultaneously supplied.

In a preferred embodiment of the invention, magnetically actuated switches are used, said switches being mounted in each of the numbering machines of the numbering assembly and said switches being controlled by means of movable magnets, the displacement of which is directly or indirectly produced by the serrated discs of the numbering machines. The advantage of such an embodiment is that it is economical because it uses a small number of inexpensive components and is reliable over a considerable useful lifetime. The present invention consequently has as an object the provision of a numbering assembly such as the one above described characterized by the fact that the indicator consists of at least one switch controlled by a movable magnet, the movement of which is produced by the serrated discs with which said indicator is associated.

In all of the embodiments of the invention each monitoring numbering machine may advantageously have the same number of serrated discs as the numbering machine being checked. The numbering machine being checked and the monitoring numbering machine may advantageously be identical and simultaneously controlled preferably by the same means. It is also possible to provide for the error signal to produce an indication permitting the identification of the associated serrated discs for which there is no concordance in the indicating signals and/or in which said signal is utilized to stop the printing machine with which the numbering machine being monitored is associated.

In the embodiments in which magnetic switches are used, the switch or switches which constitute the indicating checking device may advantageously be a simple switch having an input and an output. Another possibility is for the switch or switches which constitute the indicating device to be a two position or double throw switch or switches, each comprising an input and two outputs, $S_1$ and $S_2$ one or the other of which, depending upon the position of the switch, are connected to the input.

This specification will hereinafter provide more specific information concerning the preferred embodiment which uses magnetically actuated switches.

In a first variation each serrated disc of the numbering machines constituting the assembly of numbering machines carries a plurality of magnetic switches. In another variation each serrated disc of the numbering machines constituting the assembly of numbering machines is associated with a wheel which it drives in rotation, for example, through gearing, said wheel carrying a plurality of magnets. For these two variations, in the case in which the serrated disc comprises $2n$ printing faces, the magnets are $n$ in number and regularly spaced on the wheels which carry them. In another variation each serrated disc of the numbering machines constituting the assembly of numbering machines is associated with a cam which controls the movement of at least one magnet. In this case, if the serrated disc comprises $2n/$ printing faces, the cam comprises $n$ bosses regularly spaced. If the cam has $n$ bosses directly attached to the serrated disc, it is advantageous for the bosses of the cam to each be in alignment with the central zone of a printing face of the serrated disc. Each cam may control a magnet capable of translational movement. Each cam may also control a magnet through an intermediate pivoting lever. In all cases the switches are positioned in the same manner with respect to the serrated disc or the components driven by these discs, for each of the numbering machines constituting the numbering machine assembly, so that the two corresponding switches have an identical behavior when the two corresponding serrated discs with which they are associated are in identical positions.

In a first embodiment each serrated disc of the numbering machines constituting the assembly of numbering machines is associated with two simple switches which are diametrically opposed with respect to the serrated wheel, one of the switches being open when the other switch is closed. Each of the two switches associated with a single serrated disc is connected through its input terminal to one of the terminals of a source of direct electric current and at its outlet terminal to the terminal of the same polarity of an alarm adapted to utilize the error signal which is produced, the two switches of the same serrated disc not being connected to the same polarity of the supply source and the two corresponding switches of corresponding serrated wheels of the numbering machines constituting the assembly of numbering machines having their outputs connected in parallel to the same terminal of the alarm.

In a second embodiment also, two simple, diametrically opposed switches for each serrated disc of those numbering machines constituting the numbering machine assembly, the two switches associated with the serrated disc of a first numbering machine having their input terminal connected to the same pole of the DC supply, the output of one of these switches is connected to the input of the switch which does not correspond thereto but which is associated with the corresponding serrated disc of the second numbering machine, the two outputs of the two switches of the second numbering machine being connected in parallel to the terminal of corresponding polarity of an alarm system adapted to utilize the error signal which may be furnished.

In a third embodiment comprising a single simple switch for each serrated disc of the numbering machines constituting the assembly of numbering machines, the switch associated with each two discs is interposed between an electrical supply terminal and the corresponding terminal of a comparator controlling an alarm system adapted to respond to the error signal which may be produced, the switches associated with the corresponding serrated discs being positioned in parallel between the comparator and the electrical supply.

When two position or double throw switches are used, each of which comprises an input and two outputs, $S_1$ and $S_2$, it is generally sufficient to use a single switch for each serrated wheel being checked or each monitoring wheel. In a first variation the reversing switches associated with the two corresponding serrated wheels of two numbering machines constituting an assembly of numbering machines comprising a checked numbering machine and a monitoring numbering machine are connected at their input to the two polarities of the electrical supply, the outlet $S_1$ of one of the reversing switches and the outlet $S_2$ of the other two position or double throw switch being associated to be connected to the supply terminals of two alarm devices. In a second variation the reversing switch associated with one of the serrated discs has its input terminal connected to one of the electrical supply polarities, the two switches associated with the two serrated discs corresponding to two numbering machines constituting the numbering machine assembly having their output terminals connected to each other so that the output terminal $S_1$ of one is connected to the output terminal $S_2$ of the other. The input of the two position or double throw switch which is not directly connected to one of the polarities of the electrical supply is connected to the terminal of corresponding polarity of an alarm device, the other terminal of which is permanently connected.

The switches used may be of different types but must always be of small size in view of the fact that the numbering machines are themselves small. Hall effect probes may advantageously be used as switches but these probes must necessarily be associated with certain electronic components so that the cost of such an embodiment is, in general, considered too high. It is preferred to use as switches those switches consisting of a sealed ampoule enclosing two flexible magnetic blades, the relative positions of which are modified when the ampoule is within the field of a magnet. These flexible blade switches are known in the state of the art and are, in particular, sold commercially by Orega, C.C.

It is clear that the device according to the invention makes it possible to emit an error signal as soon as one of the serrated discs of the numbering machine being checked ceases to have the same position as the corresponding serrated wheel of the monitoring machine. This error signal may be used to actuate an indicator showing which pair of serrated wheels are out of synchronism. This error signal may also be used to start a sound warning signal for stopping the printing machine in which the numbering machine being checked is inserted. Nevertheless it should be noted that the malfunctions in operation of the monitoring numbering machine are added to the malfunctions in operation of the numbering machine being checked which, when the monitoring numbering machine is not used for printing, doubles the number of stops as compared with those which correspond solely to malfunction in the operation of the printing numbering machine. This disadvantage need not be taken into consideration when the monitoring numbering machine is a numbering machine also used for printing in the typographical composition.

When an error signal is emitted, it is desirable to be able to quickly detect which is the serrated disc of the numbering machine being checked which does not have the same position as the corresponding serrated disc of the checking numbering machine. For this purpose it is possible to arrange for the error signal emitted to produce an indication identifying the two serrated discs which are not properly synchronized. This indication limits the time work is stopped and consequently the down time of the machine. On a printing machine it is desirable that the checking of the good operation of the printing numbering machines be carried out after the end of a printing step, that is to say after all the coupled numbering machines of the typographic composition have operated, for example, in the case of an alternating machine, a check may be carried out at the moment at which the movable member is at one end of its reciprocating path of travel.

In order that the object of the invention may be better understood, several embodiments thereof will now be described, purely by way of illustration and example, with reference to the accompanying drawings, in which.

Figure 6:
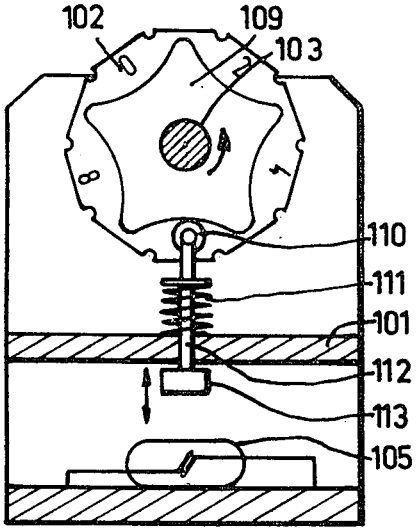
Figure 8:
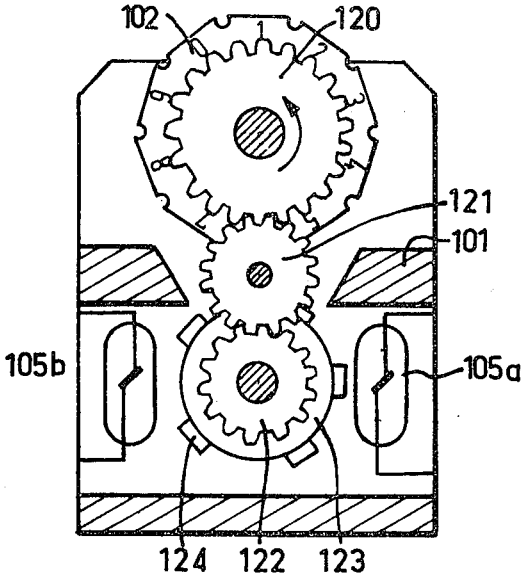
Figure 7:
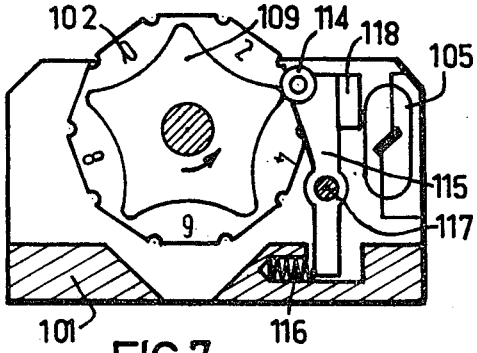

FIG. 6 schematically illustrates one of the numbering machines of an assembly of numbering machines comprising two identical numbering machines coupled together, with each serrated disc of this numbering machine being associated with a cam which controls the reciprocation of a magnet adapted to actuate a flexible blade switch;

FIG. 7 shows a variation of the embodiment of the numbering machine of claim 6, the movement of the magnet associated with the flexible blade switch being produced by a pivoting lever; and FIG. 8 schematically illustrates the numbering machine of an assembly of numbering machines according to the invention in which each serrated disc is associated with gearing which controls the rotation of a magnet-carrying wheel, said magnets cooperating with two switches.

Referring to the drawings, it will be seen that, on all the figures, the numbering machines of the numbering assembly according to the invention have been shown in transverse section perpendicular to the common axis of the serrated discs of the numbering machine. On all the figures reference numeral 101 designates the frame of the numbering machine and 102 the particular serrated printing disc just below the plane of the section. The disc 102 is adapted to turn about the shaft 103. The numbering assemblies which will be hereinafter described each comprise a checked numbering machine and a monitoring numbering machine, said two numbering machines being identical. Each numbering machine comprises a certain number of printing discs 102 positioned side by side on the same axis 103. There may, for example, be seven printing discs 102 in each numbering machine. Each disc 102 comprises 10 printing faces on which are engraved the numbers from 0 to 9. Each disc 102 may be driven by a known device, not shown, so that the 10 printing faces are brought successively into the printing position (to wit, on all the figures, the one which is turned upwardly).

FIGS. 1 to 5 show the serrated discs 102 each comprising 5 micro-magnets 104 positioned radially and separated from each other by two printing faces. These micro-magnets 104 are samarium-cobalt magnets inserted in seats formed in the body of the serrated disc.

Figure 1:
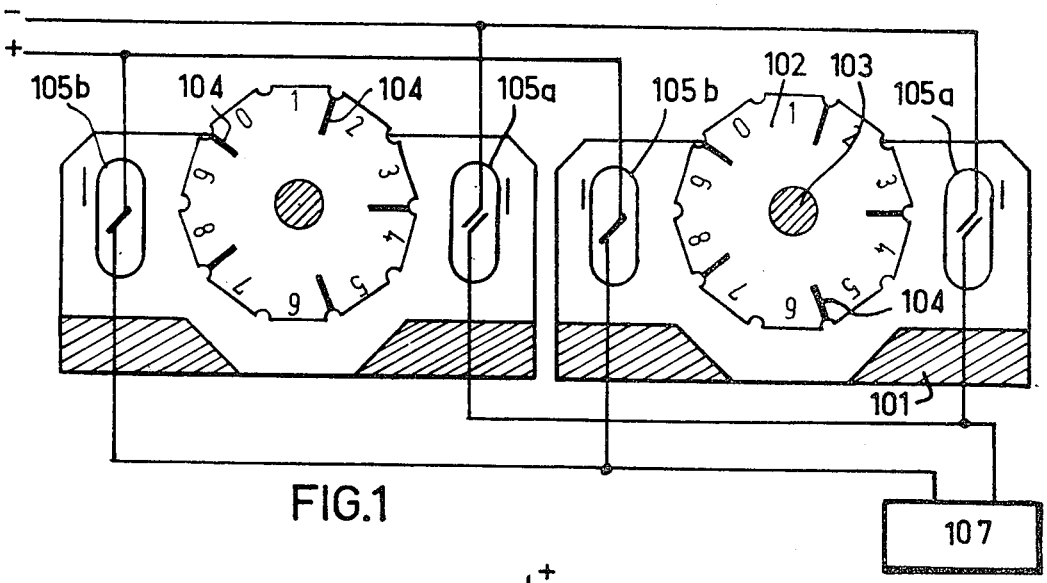
FIG. 1 shows schematically one embodiment of a numbering machine in which two diametrically opposed switches are used for each serrated disc with one switch of each disc connected to the positive supply and one switch of each disc connected to the negative supply.
Figure 2:
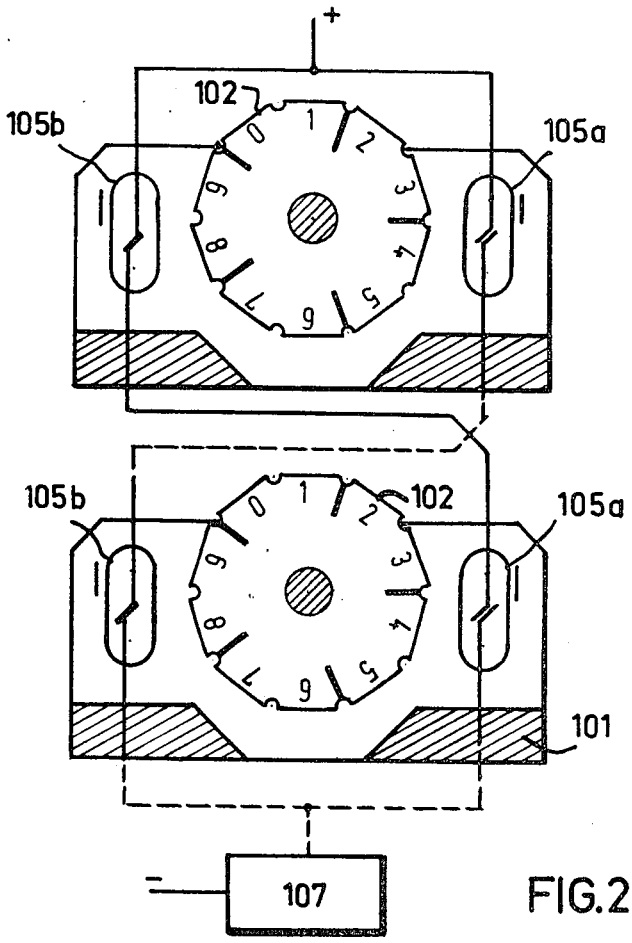
FIG. 2 shows a variation of the arrangement of FIG. 1.
Figure 4:
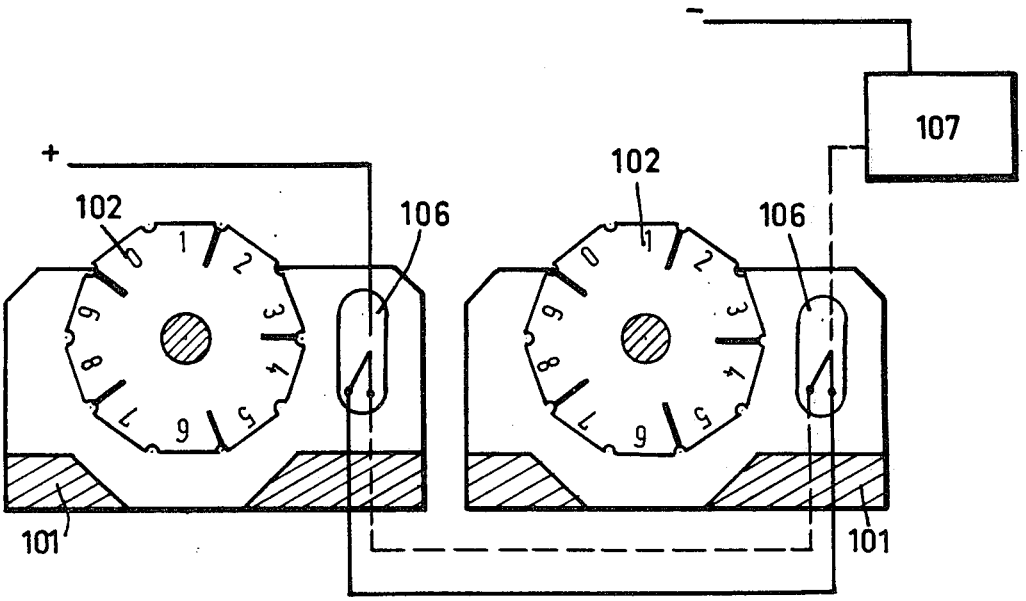
FIG. 4 shows a variation of the arrangement of FIG. 3.
Figure 5:
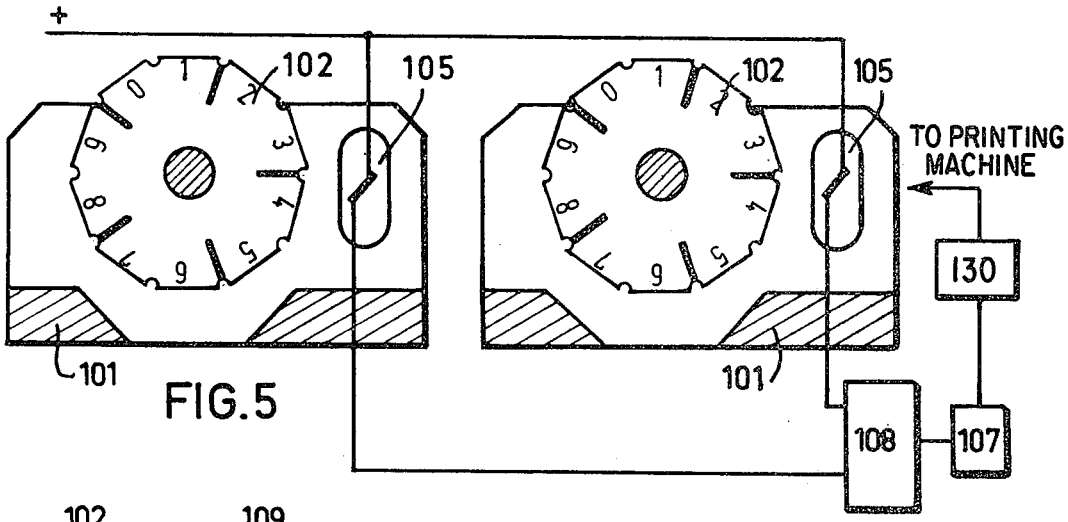
FIG. 5 shows schematically, another embodiment having a switch associated with each serrated disc and having a comparator monitoring the outputs of the switches.

FIGS. 1, 2 and 5 show the use of switches consisting of simple switches having an input terminal and an output terminal and indicated by reference numeral 105 associated with a letter which constitutes a distinctive indicia. The variations shown on FIGS. 3 and 4 utilize two position or double throw switches comprising an input terminal and two output terminals $S_1$ and $S_2$. These two position or double throw switches have been designated by reference numeral 106 and can be single pole double throw switches. Switches 105 and 106 are flexible blade switches called ILS and sold by the Orega Company of the Thomson CSF group. These switches comprise a glass ampoule inside which are two flexible magnetic metal blades which may contact each other at their ends, the relative position of the two blades being modified when the ampoule is in a magnetic field. The ampoule contains a controlled atmosphere to avoid oxidation of the contacts and the ends of the flexible blades are soldered to the ends of the ampoule and constitute the terminals of the switch. In all the embodiments the switches 105 and 106 associated with two corresponding serrated discs 102 are identically positioned with respect to each serrated disc 102 of two numbering machines of the same numbering assembly. The arrangement adopted is such that, when a printing face which is out of synchronism is in printing position the switches are in a first state whereas when a properly synchronized printing face is in printing position the switches are in a second state.

The variation shown on FIG. 1 shows that two diametrically opposed switches 105*a* and 105*b* are used for each of the serrated discs of the two numbering machines of the numbering assembly according to the invention. In this embodiment the inputs of the two switches 105*a* are connected to the negative supply terminal. The inputs of the switches 105*b* are connected to the positive supply terminal. The outputs of the switches 105*a* are connected in parallel to the negative terminal of an alarm device 107 and the outputs of the switches 105*b* are connected in parallel to the positive terminal of the alarm device 107. With this arrangement, if the printing surfaces of the two serrated discs 102 occupy the same position a single terminal of the alarm 107 is supplied. If, on the contrary, there is a difference in position between the printing surfaces, or even if one of the two serrated discs has turned too far or too little and is not in a position suitable for printing, the two terminals of the alarm 107 are supplied so that the alarm goes off.

In the embodiment of FIG. 2 each serrated disc 102 is also associated with two simple switches 105*a*, 105*b* which are diametrically opposed. In the first numbering machine the inputs of the switches 105*a*, 105*b* are connected to the positive supply. In the second numbering machine the outputs of the switches 105*a*, 105*b* are connected to the positive terminal of an alarm device 107, the negative terminal of which is permanently supplied. The output of the switch 105*a* of the first numbering machine is connected to the input of the switch 105*b* of the second numbering machine. The output of the switch 105*b* of the first numbering machine is connected to the input of the switch 105*a* of the second numbering machine. When the two corresponding serrated discs 102 of two numbering machines which are being compared have properly synchronized printing faces, the positive terminal of the alarm 107 is not supplied. On the contrary if these faces are not synchronized or if one of the serrated discs has not turned to an angle suitable for printing (in which case it is said that there is a serrated disc straddling) the positive terminal of the alarm is supplied and the alarm is set off.

Figure 3:
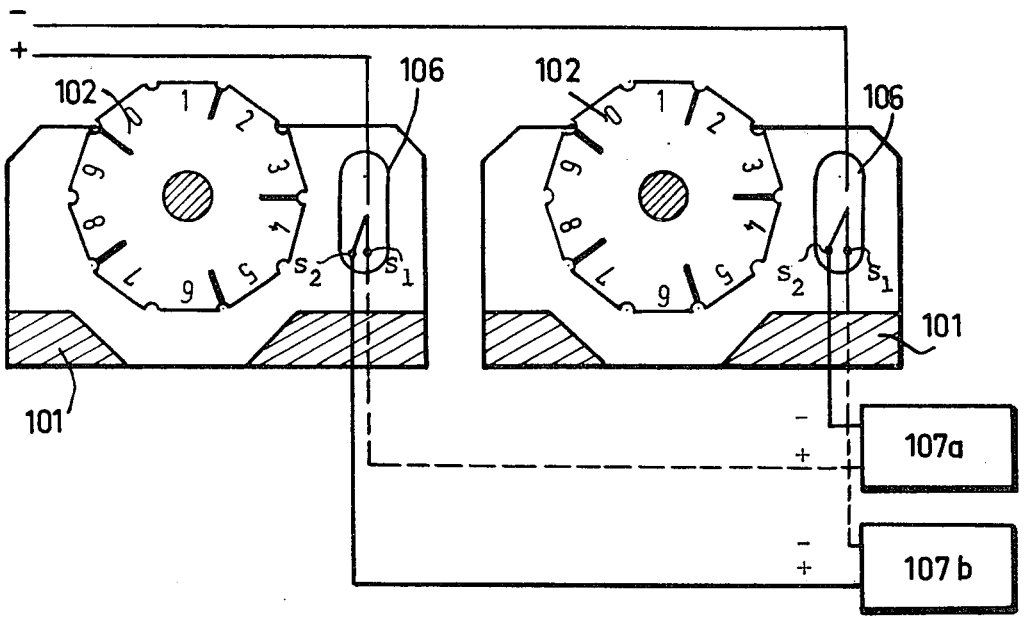
FIG. 3 shows schematically another variation in which each serrated disc is associated with a double throw switch.

In the device of FIG. 3, each serrated disc 102 is associated with a single two position or double throw switch 106. When odd-numbered printing surface is in printing position the outlet $S_1$ of the switch 106 is connected to the input terminal and the terminal $S_2$ is not supplied. The opposite takes place when an even numbered printing face is in printing position. The input terminals of the two switches 106 are respectively connected to the positive and negative supplies. The device comprises two alarms 107*a* and 107*b*. The alarm 107*a* has its positive terminal connected to the output $S_1$ of the first numbering machine and its negative terminal connected to the output $S_2$ of the second numbering machine. The alarm 107*b* has its positive terminal connected to the output $S_2$ of the first numbering machine and its negative terminal connected to the output $S_1$ of the second numbering machine. If both the printing surfaces which are in a printing position are odd or both are even, only one of the terminals of each of the two alarms is supplied so that the alarm is not set off. On the contrary, if one of the surfaces in printing position is odd and the other even (or if a serrated disc is in a straddle position), one of the two alarms 107*a* or 107*b* has both its terminals supplied and is therefore set off.

In the embodiment of FIG. 4 a two position or double throw switch 106 is also used in association with each of the serrated discs 102 of the numbering machine. With respect to the position of the serrated discs 102 the operation of the switches 106 is identically the same as in the embodiment of FIG. 3. The input of the switch 106 of the first numbering machine is connected to the positive supply and the input of the switch 106 of the second numbering machine is connected to the positive terminal of the alarm 107, the negative terminal of said alarm being permanently connected to the negative supply. The output $S_1$ of the switch 106 of the first numbering machine is connected to the output $S_2$ of the switch 106 of the second numbering machine and the output $S_1$ of the switch 106 of the second numbering machine is connected to the output $S_2$ of the switch 106 of the first numbering machine. If both the numbers on the printing surface in a printing position are odd or both are even for two numbering machines the positive terminal of the alarm 107 is not supplied. In the contrary case, or if one of the serrated discs is straddling, the positive terminal of the alarm 107 is supplied and the alarm is set off.

The embodiment of FIG. 5 uses, for each of the serrated discs 102 of the two numbering machines, a simple switch 105. The switches 105 are closed when the printing faces which are in printing position are matched and open in the contrary case, or one of the serrated discs is in a straddling position. The two inputs of the two switches 105 belonging to the two corresponding serrated discs 102 are connected in parallel to the positive supply and the two outputs are connected in parallel to a comparator 108 the output of which is adapted to set off an alarm 107. When the two surfaces in printing position have the same value, the two inputs of the comparator 108 are either both supplied or both unsupplied. In this case the output of the comparator 108 is not supplied and the alarm is not set off. On the contrary if there is a difference between the values on the two printing surfaces of the two serrated discs being compared (or if one of these serrated discs is in a straddling position) one of the inputs of the comparator 108 is supplied while the other is not, so that the output of comparator 108 is supplied and consequently the alarm 107. Alarm 107 can be connected to an interrupter 130 which is activated along with the alarm to stop the printing machine when a difference occurs.

In the embodiment of FIGS. 1 to 5 the magnets which control the switches 105 and 106 are carried directly by the serrated discs 102. In certain cases it may be difficult to mount the magnets in the serrated discs. In such a case the serrated discs may be caused to indirectly control one or more magnets, the movement of which actuates the switches, such as the switches 105 and 106 of the embodiments of FIGS. 1 to 5. FIGS. 6 to 8 show such indirect means for controlling one or more magnets from a serrated disc 102.

On FIG. 6 it will be seen that each serrated disc 102 is associated with a cam having five regularly spaced bosses 109, each boss being in alignment with the central zone of one printing face. The cam 109 cooperates with a roller 110 which is biassed against its edge by a spring 111. The roller 110 is positioned at the end of a rod 112, the other end of which carries a magnet 113. The rod 112 is adapted to move translationally, perpendicular to the axis 103 of the roller, in alignment with a flexible blade switch 105. It will be seen that rotation of the cam 102 changes the relative position of the magnet 113 and the switch 105. When an odd printing face is in printing position, the magnet 113 is moved away from the switch 105 and the switch is closed. In the contrary case, or if the serrated disc is in a straddling position, the switch 105 is opened. It will thus be seen that the result obtained is the same as in the arrangement previously described in the case of the embodiments of FIGS. 1 to 5.

The embodiment of FIG. 7 is a variation of the embodiment of FIG. 6. In this variation each serrated disc 102 is associated with a cam 109 identical to the one in the embodiment of FIG. 6. The cam 109 cooperates with a roller 114 positioned at the end of a pivotally mounted lever 115 subjected to the action of a spring 116. The pivoting lever is mounted to turn about the shaft 117 and carries at its end adjacent the roller 115 a magnet 118 which cooperates with a flexible blade switch 105 positioned opposite said magnet and carried by the chassis of the numbering machine 101 to which the serrated disc 102 belongs. The rotation of the serrated disc 102 results in oscillation of the lever 115 and consequently an alternating modification of its position relative to the magnet 118 and the switch 105. When the printing faces are of unequal value, the switch 105 is in open position. In the contrary case, or if the disc is in a straddling position, the switch 105 is in closed position. It will be seen that by means of this arrangement a result analagous to the one obtained in the embodiments of FIGS. 1 to 5 may be obtained.

Finally, on FIG. 8, a variation is shown in which each serrated disc 102 of a numbering machine 101 is associated with a gear 120 which cooperates with an intermediate pinion 121, the shaft of which is carried by the chassis of the numbering machine 101. The intermediate pinion 121 cooperates with a gear 122 fixed to a wheel 123 about the periphery of which five magnets are regularly distributed. When the serrated disc 102 is driven in rotation the wheel 123 is also rotated and the magnets 124 move opposite the diametrically opposed switches **105*a* and 105*b*. The switches 105*a* and 105*b* and the pinions 120, 121 and 122 are so positioned that when printed surfaces of unequal value are in printing position the switch 105*a* is open whereas the switch 105*b* is closed. The converse is the case when the printing surfaces are of the same value. This arrangement makes it possible to utilize control schemes analagous to those which are utilized in the embodiment of FIGS. 1 and 2 without having to position the magnets radially with respect to the interior of the serrated discs 102**.

It will of course be appreciated that the embodiments hereinbefore described have been given purely by way of illustration and example and may be modified as to detail without thereby departing from the basic principles of the invention. In particular, the flexible blade switches 105 and 106 may be replaced by Hall effect switches.

What is claimed is:

1. In a numbering assembly adapted to be inserted in a printing machine, said assembly comprising at least one numbering machine the operation of which is to be checked, said at least one numbering machine having a plurality of rotatably mounted printing discs, each disc having a plurality of printing faces, adapted to be brought successively into a printing position as said disc rotates, the improvement according to which said assembly also comprises at least one monitoring numbering machine having printing discs connected to rotate in synchronism with those of said at least one numbering machine to be checked, each printing disc of said monitoring machine having the same number of printing faces as the discs of said numbering machine to be checked, and each disc of each machine being connected to produce a signal when a printing face is in printing position, and indicating means responsive to said signals for producing an error signal when at least one of the discs of the machine to be checked occupies an angular position different from that of the corresponding disc of said monitoring machine.

2. Numbering assembly as claimed in claim 1 in which the printing discs of the numbering machine to be checked and the monitoring numbering machine generate for each printing position a marking signal different from one printing position to another, the signals pertaining to a printing disc of the numbering machine being checked and the corresponding printing disc of the monitoring numbering machine being supplied to a comparator which, in the absence of concordance, produces an error signal.

3. Numbering assembly as claimed in claim 1 in which each printing disc is associated with two electrical switches, each having an output, the first of said switches being in an open position when the printing face of the associated printing disc which is in printing position is even and in closed position when the face of the associated printing disc in printing position is odd, while the second switch operates in a contrary manner, the output of the first and second switches of each printing disc of the numbering machine being checked being connected in series to the inputs of the first and second switches respectively of the corresponding printed discs of the monitoring numbering machines, and comprising means for emitting an error signal when at least one of the outputs of the series of first switches or second switches differs from the output of the other series of first or second switches respectively.

4. Numbering assembly as claimed in claim 1 in which each printing disc is associated with a switch having two outputs, the connection to the first output being open when the surface of the associated printing disc in printing position is even and being closed when the face of the associated disc in printing position is odd, while the connection to the second output operates in a converse fashion, the first and second outputs of the switch of each printing disc in the numbering machine being checked being connected in parallel to the first and second outputs respectively of the switches of the corresponding printing disc of the monitoring numbering machine, and comprising means for emitting an error signal when the two outputs of the switches of the corresponding printing discs in the numbering machine being checked and in the monitoring machine are simultaneously supplied.

5. Numbering assembly as claimed in claim 1 in which the indicating means comprises at least one switch controlled by at least one movable magnet, the displacement of which is produced by the printing disc with which said indicating means is associated.

6. Numbering assembly as claimed in claim 5 in which the at least one switch comprised by the indicating device is at least one two-pole switch comprising an input and an output.

7. Numbering assembly as claimed in claim 5 in which said at least one switch is at least one double throw switch comprising an input and two outputs and one or the other of which outputs is connected to the input in dependence on the position of the switch.

8. Numbering assembly as claimed in claim 5 in which each printing disc of the numbering machines constituting the numbering assembly carries a plurality of radially positioned magnets spaced by an angle approximating the angle subtended by two printing faces.

9. Numbering assembly according to claim 5 in which each printing disc of the numbering machines constituting the numbering assembly drives a wheel carrying a plurality of magnets.

10. Numbering assembly as claimed in claim 5 in which each printing disc of the numbering machines constituting the assembly drives a cam which controls the movement of at least one magnet, said cam comprising regularly distributed bosses the centers of which are spaced by an angular distance equal to twice the distance between two successive printing faces.

11. Numbering assembly according to claim 5 which further includes, a switch connected to each numbering machine, and a member driven by each printing disc, and wherein, switches associated with corresponding printing discs, when the discs occupy identical positions, are each actuated to the same condition by said driven members.

12. Numbering assembly according to claim 5 in which each monitoring numbering machine has the same number of printing discs as the numbering machine being checked, and is simultaneously controlled.

13. Numbering assembly according to claim 5 in which the switches have flexible magnetic blades.

14. Numbering assembly according to claim 1 in which each monitoring machine has the same number of printing discs as the numbering machine being checked.

15. Numbering assembly as claimed in claim 14 in which the numbering machine being checked and the monitoring numbering machine are identical and are simultaneously controlled.

16. Numbering assembly according to claim 1 comprising means responsive to the error signal to stop a printing machine with which the numbering machine being checked is associated.

* * * * *